US005940347A

United States Patent [19]

Raida et al.

[11] Patent Number: 5,940,347

[45] Date of Patent: Aug. 17, 1999

[54] DIRECTED STICK RADIATOR

[76] Inventors: Hans-Joachim Raida, Auf dem Heidenberg 20, 50735 Koelm; Oscar Friedrich Bschorr, keplerstr. 11, 81679 Munich, both of Germany

[21] Appl. No.: 08/978,448

[22] Filed: Nov. 25, 1997

[30] Foreign Application Priority Data

Nov. 26, 1996 [DE] Germany ..... 196 48 986

[51] Int. Cl.[6] ..... H04R 1/00

[52] U.S. Cl. ..... 367/138; 367/140

[58] Field of Search ..... 367/138, 178, 367/140; 381/337–339, 342, 161

[56] References Cited

U.S. PATENT DOCUMENTS

| | | |
|---|---|---|
| 3,657,490 | 4/1972 | Scheiber . |
| 4,789,044 | 12/1988 | Akino . |

FOREIGN PATENT DOCUMENTS

| | | |
|---|---|---|
| 0-599-250-A2 | 6/1994 | European Pat. Off. . |
| 1-132-593 | 7/1962 | Germany . |
| 2-236-374-C3 | 5/1974 | Germany . |
| 2-260-741 | 6/1974 | Germany . |

*Primary Examiner*—Daniel T. Pihulic
*Attorney, Agent, or Firm*—Thorpe, North, & Western, L.L.P.

[57] ABSTRACT

An elongate, acoustic radiator (referred to as a directed stick radiator or stick radiator) consists of an exciter or oscillator emitter (11), that excites or propagates mechanical wave motion directly or by an optional adapter (12) to a mechanical waveguide with stick design. Therefore mechanical waves travel along the waveguide axes with wave velocity $c_W$. The mechanical waves cause local displacements of transformer elements (14) coupled to the waveguide that are transformed into acoustical radiation. The waveguide is terminated with an active or passive impedance termination (15), e.g. a non-reflecting impedance termination. Local sound radiations interfere and directed in-phase radiation follows. The input impedance, the directivity characteristic, the areas of the same phase and the efficiency of the radiation can be adjusted by the points of excitation, the wave velocity of the mechanical waves, the length of the waveguide, the amplitudes of displacement, the properties of the mechanical acoustical transformer and the impedance termination. The volume of the enclosure is adjusted by the properties of the waveguide and the transformer. The directed stick radiator can be used as a warning or signal device, for speech or music transmission, for noise cancellation, and working in reverse operation it can be used as directed microphone.

63 Claims, 5 Drawing Sheets

| Order | Realization | Constitution | Volume Acceleration |
|---|---|---|---|
| a) w=1 (n=1, m=0) segmented | $\xi_i$ 23a Δx 24a | $\dot{V}_i = c_a B \xi_i$<br>$c_a$ : local velocity<br>B : local width of the ith slit<br>ξ : local displacement | $\ddot{V}_i = c_a B \ddot{\xi}_i$<br>$W_i = c_a B$ |
| b) homogeneous | ξ (x) 23b dx 24b | $dV(x) = c_a \xi(x) dx$<br>$c_a$ : local velocity<br>ξ : local displacement | $d\ddot{V}(x) = c_a \ddot{\xi}(x) dx$<br>$W_{(x)} = c_a$ |
| c) w=2 (n=2, m=0) segmented | $\xi_i$ 23c 24c Δx | $V_i = A\, \xi_i$<br>A : local diaphragm area<br>ξ : local displacement | $\ddot{V}_i = A\, \ddot{\xi}_i$<br>$W_i = A$ |
| d) homogeneous | ξ (x) dx 23d, 24d | $dV(x) = B\, \xi(x)\, dx$<br>B : local width of the slit<br>ξ : local displacement | $d\ddot{V}(x) = B\, \ddot{\xi}(x)\, dx$<br>$W_{(x)} = B$ |
| e) w=3 (n=2, m=1) segmented | $\xi_i$ $\xi_{i+1}$ 23e, 24e Δx | $V_i = A\, (\xi_{i+1} - \xi_i)$<br>A : local diaphragm area<br>ξ : local displacement | $\ddot{V}_i = A\, (\ddot{\xi}_{i+1} - \ddot{\xi}_i)$<br>$W_i = A$ |
| f) homogeneous | ξ(x) ξ(x+dx) 23f, 24f A dx | $dV(x) = A\mu\, \xi'(x)\, dx$<br>A : local cross section area des<br>μ : local poisson's ratio<br>ξ : local displacement | $d\ddot{V}(x) = A\mu\, \ddot{\xi}'(x)\, dx$<br>$W_{(x)} = A\mu$ |
| g) w=m+n segmented | $\ddot{V}_i = \ddot{V}_{i^*+m/2}(t) = W_i(\omega, t, \xi_i) \sum_{j=0}^{m} (-1)^j \binom{m}{j} \xi^{(n\bullet)}_{i^*+m-j}(x, 1)$ | | |
| homogeneous | $d\ddot{V}(x, t) = W(x, \omega, t, \xi(x))\, \xi^{(n\bullet)(m')}(x, t)\, dx$ | | |

Fig. 2

| Directivity Factor Rback | Directivity Characteristic (L=0.3 λ, cw=co) | | |
|---|---|---|---|
| | Γ forward | Γ back | Γ res |
| Monopoloide | | | |
| $e^{j0\pi} = 1$ | 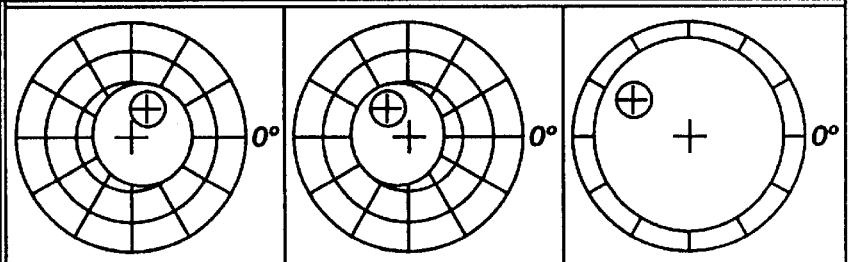 | | |
| Dipoloide | | | |
| $e^{j\pi}$ | 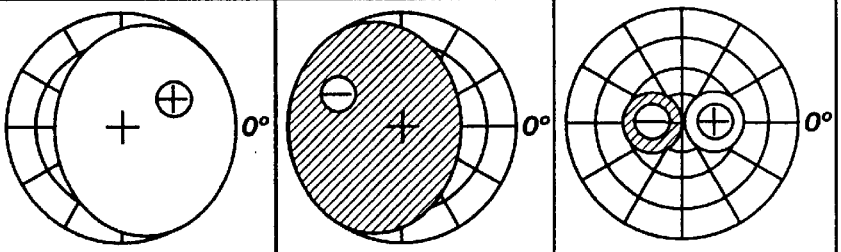 | | |
| Cardioide I | | | |
| $\left\lvert \sin\left(\frac{2\pi L}{\lambda}\right)\frac{\lambda}{2\pi L}\right\rvert e^{j\pi}$ <br> $\Gamma_{forward}(0\ 180°, L)$ | 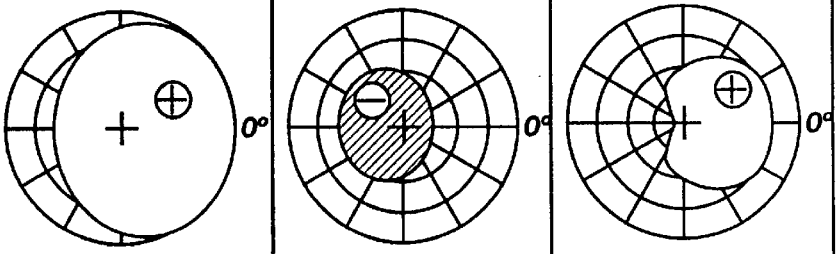 | | |
| Cardioide II | | | |
| $\frac{1}{\left\lvert \sin\left(\frac{2\pi L}{\lambda}\right)\frac{\lambda}{2\pi L}\right\rvert^{-1}} e^{j\pi}$ <br> $\Gamma_{forward}(0\ 180°, L)$ | 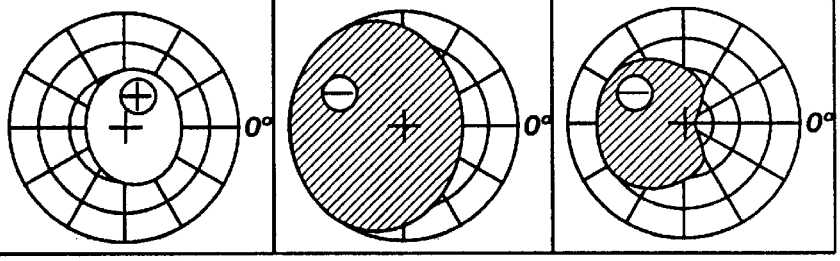 | | |

*Fig. 3*

DIRECTED STICK RADIATOR

The preferred embodiment of the present invention relates to a sound generator having an elongated or stick design, that allows broad-band radiation from ultrasonic range to the infrasound range. Specific features include an adjustable input impedance, and adjustable spectral directivity characteristic, an adjustable spectral isophase plane, an adjustable efficiency and an adjustable enclosure volume. The preferred embodiment is referred to as a directed stick radiator and can be used for signal, speech and music transmission, antisound processes such as noise cancellation, as an amplifier for musical instruments and in reverse operation as a directed microphone.

Whereas conventional sound generators (e.g. electrodynamical loudspeakers, sirens, air-modulated devices) radiate generally as monopole sources in the middle and deep frequency range, the present system can operate with any desired directivity characteristic such as a monopole, dipole, cardiode, or combinations of them. The system avoids undesired sound focusing and diffraction which often happen at high frequencies, where the wave length of the emitted sound is small in comparison to the size of the sound generator.

The present system overcomes many problems typically associated with electrodynamic loudspeakers. For example, membranes with coil and suspension systems form a highly damped, mass-spring system with resonances that have a non-linear phase response. Other factors which disadvantage prior art systems include the inertia of the membrane, the coil and the displacement dependent suspension forces, the decay of the oscillating membrane and the undesired partial oscillations of the membrane. These collectively contribute to non-linearity in amplitude and phase.

The acoustic efficiency of conventional loudspeakers is typically less than 5%. Because of their method of acting, the design of conventional loudspeakers is severely limited. Powerful sound radiation within the mid and deep frequency may cause hydrodynamic short circuits between the front and the back side of the membrane and must be avoided. Therefore big enclosures are needed that enclose loudspeaker membranes. The enclosures must have large volumes in order to guarantee a small stiffness of the enclosed air volume to ensure a deep resonance of the mass-spring system and radiation at deep frequencies. The walls of the enclosure must be heave and stiff in order to avoid vibrations of the walls. Additionally the enclosure has to be lined with damping material to damp standing waves of the enclosed air volume.

Therefore, an object of the present invention is to provide a sound generator with stick design that allows broad-band radiation from the ultrasonic to the infrasonic range with adjustable input impedance, adjustable spectral directivity characteristic, adjustable isophase planes, adjustable spectral efficiency and adjustable enclosure geometry.

In accordance to the present invention, this object is to be accomplished by providing a directed stick radiator (FIG. 1) consisting of an exciter (11) that excites directly or by an optional adapter (12) a mechanical waveguide with stick design so that mechanical waves travel along the waveguide in direction of the waveguide axes with spectral velocity $c_W$ and cause local displacements $\xi$, that are transformed by the mechanical acoustical transformer (14) into local, retarded sound radiation. The waveguide is terminated with an impedance termination (15) and the superpostion of the local, retarded sound radiations result in enhanced total sound radiation and the spectral input impedance of the waveguide and the spectral directivity characteristic, the spectral isophase plane and the spectral efficiency are adjusted by the point or points of excitement, the wave velocity, the waveguide length, the local displacement, the properties of the mechanical acoustical transformer and the impedance termination. The necessary enclosed volume depends on the waveguide and transformer properties.

DESCRIPTION OF THE INVENTION

The present invention is embodied with numerous physical structures, along with relationships defined within equations set forth hereafter with respect to these equations, a spectral vector load $\Lambda$ and a corresponding spectral vector displacement $\xi$ is defined (all following variables are spectral, even if this is not explicitly said)

$$\Lambda = \{\text{force}, \text{momentum}, \ldots\} \quad \xi = \{\text{distance}, \text{angle}, \ldots\}$$

Corresponding variables (e.g. force-distance, momentum-angle) are connected by the spectral impedance Z $$Z = \Lambda / \xi$$

The spectral power $P_E$ of the exciter (index „E") for harmonic excitation is $$P_E = \frac{1}{2} \cdot \begin{cases} \hat{\Lambda}_E \hat{\xi}_E & \text{general excitation} \\ \hat{\Lambda}_E^2 / Z_E & \text{load excitation} \\ Z_E \hat{\xi}_E^2 & \text{displacement excitation} \end{cases}$$

The effective mechanical power (real part of $P_E$) that can be introduced into the stick radiator depends on the excitation and the impedance. For load excitation, low impedance is advantageous. For displacement excitation, high impedance is of advantage. For general excitation, all known emitters or exciters can be used, e.g. electrodynamical, piezoelectric-electric, mechanical, pneumatic, hydraulic and thermic, balanced and unbalanced exciters, resonators, mechanical vibration exciter or any vibrating structure (engine surface etc.).

The general physical embodiment of the present invention in its most basic form and which is structured in accordance with the mathematical relationships disclosed hereafter includes the following basic components: an exciter or driver 11 for generating mechanical wave energy, an elongate wave guide 13, a plurality of transformer elements for converting the mechanical wave energy into acoustical output to the surrounding environment, and some means for minimizing any reflection of forward traveling waves, referred to as an impedance termination 14. In addition, an adapter 12 may be needed to ensure efficient transfer of mechanical energy from the exciter 11 to the waveguide 13. This general combination of elements is represents in FIG. 1.

In a broad sense, the present invention provides an acoustic emitter capable of emitting acoustic energy which is in-phase and directional. The exciter member 11 provides the mechanical wave propagation source. The optional adapter 12 couples between the exciter and the waveguide 13. The elongate wave guide 13 is comprised of material configured with a shape which provides a transfer medium for mechanical waves generated by and received from the exciter member. A key component of the present system is the transformer elements which are disposed along the wave guide. These transformer elements are mechanically coupled to the wave guide and have a structure which is distinguishable from structure of the waveguide because of differences in (i) acoustical shape, (ii) material composition (iii) structural orientation, (iv) three dimensional complex impedance or (iv) any combination of acoustical shape, material composition structural orientation, three dimensional complex impedance combined. Each transformer element has an acoustical shape configured to convert mechanical energy received from the wave guide into acoustical output in a surrounding medium. Preferably, at least one of the transformer elements is configured in combination with the wave guide for emitting monopole, acoustic radiation. The impedance termination is acoustically coupled to the wave guide for minimizing reflection of forward traveling waves propagated along the wave guide.

Instead of one exciter, many exciters can be placed either at single points or continuously along the waveguide axes. If necessary the exciter signal can be pre-distorted by known means and methods. If the output impedance of the exciter does not match the input impedance of the waveguide, an additional adapter is used to adapt impedances of exciter and waveguide. If input impedance is mentioned without any supplement the impedance of the adapter and the waveguide or the impedance of the waveguide (if no adapter is used) are meant.

The adapter has an input and an output impedance. For transmission of high mechanical power the input impedance has to be small in case of load excitement and high in case of displacement excitation. The output impedance of the adapter matches the input impedance of the waveguide. If impedance matching occurs without dissipation or other losses, it follows that (adapter output and waveguide input without index x=0)

$$P_E = \frac{1}{2}\hat{\Lambda}_E\hat{\dot{\xi}}_E = \frac{1}{2}\hat{\Lambda}(x=0)\hat{\dot{\xi}}(x=0) = P(x=0)$$

All known technical hardware solutions for impedance adaption/transformation can be used (e.g. mechanical transmission like lever, exponential horns, transmission box, gear wheels, crank and cam mechanism, hydraulic or pneumatic transmission, mechanical network). The waveguide with stick design is used to guide the mechanical waves that are introduced by the exciter through the adapter.

The waveguide has cam effective spectral radiating waveguide length L that can be shorter than the real length of the waveguide. The mechanical waves (e.g. longitudinal waves, quasi longitudinal waves, elastic waves, transversal waves, torsional waves, bending waves or combinations of them) travel along the waveguide axis in positive x direction with wave velocity $c_W$. Corresponding to their properties, quasi-/homogeneous waveguides (coordinates x) and quasi-/segmented waveguides with N segments (N≧1) with the constant or variable segment length $L_i$ and the index i can be distinguished as follows:

a) homogeneous waveguide—no change of properties in x direction (e.g. wire, ribbon, tube, duct);

b) quasi-homogeneous waveguide—no abrupt change, but gradual changes in properties in x direction (e.g. spiral, horn, waveform);

c) quasi-segmented waveguide—abrupt change of properties of the waveguide in x direction, waveguide consists of only one part (e.g. split spring (see FIG. 6) folded waveguide);

d) segmented waveguide—abrupt change of properties of the waveguide along the waveguide axes that consist of many segments (e.g. wire with masses, waveguide with alternating masses and springs)

The mentioned properties of the waveguide are the wave velocity and/or the local impedance, and/or the outer design and/or other known material characteristic values or parameters. The single segments of a segmented waveguide can consist of several mechanical components. The local wave velocity of the waveguide can be calculated for the longitudinal waveguide (other waveguides can be calculated in analog or similar manner) ("quasi-/homogeneous" means quasi-homogeneous and/or homogeneous, "quasi-/segmented" means quasi-segmented and/or segmented)

$$c_W(x) = \sqrt{E(x)/\rho(x)} \quad \text{quasi-/homogeneous}$$

$$c_{W_i} = L_i\sqrt{C_i/M_i} \quad \text{quasi-/segmented}$$

with the local, spectral elasticity modul E(x), the local density ρ(x), the stiffness $C_i$ and the mass $M_i$ of the i-th segment. The local spectral impedance of a non-reflecting or infinitive longitudinal waveguide can be calculated as m' mass per unit length of the quasi-/homogeneous waveguide)

$$Z(x) = m'(x)c_W(x) \quad \text{quasi-/homogeneous}$$

$$Z_i = \frac{M_i}{L_i}c_{Wi} \quad \text{quasi-/segmented}$$

The impedance at the waveguide beginning x=0 is the input impedance and is constant for a non-reflecting waveguide with constant mass per unit length and constant wave velocity and an adapter without distortion. For the transportation of high mechanical power high mass per unit length and a high wave velocity is necessary. The input impedance with respect to the local impedance is adjusted by the properties of the mechanical acoustical transformer, the output impedance and the properties of the adapter. The mechanical waves cause retarded local displacements ξ(x, t-x/$c_W$). The retardation time x/$c_W$ follows from the time the mechanical waves take to travel with wave velocity from x=0 to the point x.

By using the exciter and the adapter simultaneously, several independent mechanical waves with different wave velocities can be introduced into the waveguide (e.g. longitudinal and transversal waves). The mechanical acoustical transformer transforms local displacement ξ(x,t) from the waveguide into local volume acceleration $d\ddot{v}$ (x,t) or local force $d\vec{F}$(x,t) acting on the ambient air. The local volume velocity causes local monopole radiation, or local force dipole radiation. The transformer can be built quasi-/homogeneous and/or quasi-/segmented and need not be built the same way as the waveguide. For example the mechanical acoustical transformer(s) can be partly or totally integrated into the waveguide. Because there can exist one or more transformers, the following examples of one transformer will be regarded as representing any number of transformers. The waveguide and transformer can be formed as a unit or can be separated. Therefore "waveguide/transformer" will be used to describe both the waveguide or the transformer or both in common. The following considerations are valid in an analogous way for the force $d\vec{F}$(x,t) (x,t) acting on the ambient air. This aspect will not be treated here. The volume acceleration of the quasi-/homogeneous and the quasi/segmented mechanical acoustical Wandlers $d\ddot{V}$(x,t) (x,t) respectively $\ddot{V}$ are (see FIG. 2)

$$d\ddot{V}(x,t) = W(x,\omega,t,\xi(x))\xi^{(n\bullet)(m')}(x, t - x/c_W)dx \quad \text{quasi-/homogeneous}$$

$$\ddot{V}_i(t) = \ddot{V}_{i^*+m/2}(t) = W_i(\omega,t,\xi_i)\sum_{j=0}^{m}(-1)^j\binom{m}{j}\xi^{(n\bullet)}_{i^*+m-j}(t - x/c_W) \quad \text{quasi-/segmented}$$

with the n-th differentiation (n•) with respect to the time t and the m-th differentiation (m') with respect to the distance x. In the quasi-/segmented case the (i*+m/2)the segment is located as virtual segment between the i th and (i+m)th segment. The order of the transformer is defined as w=m+n. Negative n with respect to m stands for integration with respect to the time t or distance x. The spectral, local transformer function $W_i$ (ω,t,ξ) or W(x,ω,t,ξ) expresses the local properties of the segmented and homogeneous transformers, respectively, that establish proportionality between (i) the mentioned derivative of the displacement of time and/or distance and (ii) the volume acceleration, as to be seen in FIG. 2 *a*) to *f*). Typical features which are represented within the transformer function are local radiation area A(x), slot width or window width B(x), which can be outlet velocity (constant or time dependent) cα(x,ξ,l) of a fluid, segment length $L_i$, frequency response of a lever transformation or of a mechanical network that transforms the displacement into volume acceleration, an opposite sign (for example, if elements are build in x-direction but reversed). The transformer function can also depend on the displacement ξ (e.g. an outlet velocity depending on the displacement), or the time t (e.g. deep frequency modulation of the transformer properties, or be controlled by the exciter), or be actively controlled (e.g. by feed-forward control or feed-backward control). The differentiations with respect to the distance or the time can be transformed into each other.

Because the single transformer does not act as an oscillation vibration system, but moves like the waveguide and has nominal attenuation, it passes on substantially all mechanical power. A small enclosure that is built around the transformer may be necessary to avoid hydrodynamic short circuit.

The waveguide makes use of the stiffness of the enclosed air as additional or total stiffness for a segment, see FIG. 2, *e*). The waveguide may also have no fixed housing, see also FIG. 2, *e*). When the impedance of the waveguide is very low (low mass, inertia and/or low stiffness), the stiffness of the enclosure has an influence on the propagation of the mechanical waves. If the stiffness of the enclosure is significantly higher than the stiffness of the waveguide evanescent wave propagation follows. This can be used to transmit more mechanical power at deep frequencies because the waveguide impedance increases at evanescent wave propagation. This can be avoided by increasing the waveguide impedance. For the ongoing calculations the structure impedance termination will be generally non-reflecting, so that mechanical waves only travel into a positive x direction.

The impedance termination will be treated later in detail. The resulting sound pressure in free space (far field) in distance r depending on the angle θ can be calculated by integration of the local volume velocities along the waveguide transformer (harmonic excitation supposed) as follows, $$p(r,\vartheta,t) = \frac{\rho_o}{4\pi r}\cdot\begin{cases}\displaystyle\int_0^L d\ddot{V}\left(x, t - \frac{x}{c_W} + \frac{x}{c_o}\cos(\theta) - \frac{r}{c_o}\right) & \text{homogeneous,quasi-homogeneous}\\ \displaystyle\sum_{i=1}^{N}\ddot{V}_i\left(t - \frac{x_i}{c_W} + \frac{x_i}{c_o}\cos(\theta) - \frac{r}{c_o}\right) & \text{segmented,quasi-segmented}\end{cases}$$

with density of the ambient air $\rho_o$. The maximum sound pressure amplitude in free field (far field) without consideration of damping follows to $$\hat{p}_{\max}(r) = \frac{\rho_o}{4\pi r}\begin{cases}\displaystyle\int_0^L d\hat{\ddot{V}} & \text{quasi-/homogen}\\ \displaystyle\sum_{i=1}^{N} d\hat{\ddot{V}}_i & \text{quasi-/segmentiert}\end{cases}$$

The frequency response function sound pressure to excitation is proportional to $$\frac{p}{\Lambda} \sim \omega^{w-1} \quad \text{load excitation}$$

$$\frac{p}{\xi} \sim \omega^{w} \quad \text{displacement excitation}$$

By predistortion (e.g. integration or differentiation) of the exciter signal or by the frequency response of the exciter, the waveguide or transformer, it is possible to realize any frequency response between excitation and sound pressure. The following expressions can be derived also for the segmented waveguide, as has been done for the homogeneous waveguide. The transformer function will be set as a constant for easier description of the acoustical radiation. The acoustical radiation with variable transformer function can be derived in analogous manner. With spectral damping β the decrease in amplitude of the displacement ξ(x,t) by acoustical radiation and dissipation can be formulated as $$\hat{\xi}(x)=\hat{\xi}(x=0)e^{-\beta x}$$

and with function γ (indices "−" respective "+": forward respective backward traveling waves)

$$\gamma_{\pm}(\theta) = \frac{\pi L}{\lambda}\left(\cos(\theta) \mp \frac{c_o}{c_W}\right) + j\frac{L\beta}{2}$$

sound pressure follows after performing the integration (wavenumber k=ω/cO)

$$p(r,\theta,t) = \hat{p}_{\max}(r)\frac{\sin(\gamma_+(\theta))}{\gamma_+(\theta)}e^{j\gamma_+(\theta)}e^{j\omega t - kr}$$

Effective radiation follows corresponding to the combination of waveguide length and wave velocity. With short waveguides (L<<λ) even for low wave velocity ($c_W$<$c_O$)

effective radiation can be reached. Directivity characteristic Γ follows $$\Gamma(\theta, L) = \left|\frac{\sin(\gamma_+(\theta))}{\gamma_+(\theta)}\right|$$

Directivity characteristic can be adjusted by the place or the section of excitation, the choice of the wave velocity, the geometrical form of the waveguide, the waveguide length L, the local volume acceleration and the local sound radiation corresponding to the defined transformer function, and the frequency dependance of the exciter, adapter and waveguide/transformer. With each waveguide length L respective wavevelocity cW cardioid or monoploid or other characteristic can be achieved by adjusting the other parameter. Even with very short waveguide length (L<λ/2) cardioid directivity or other directivity can be achieved by using an additional monopole source at the waveguide preferably in the middle x=L/2 of the waveguide (x=L/2), e.g by an additional waveguide/transformer or transformer element or a conventional sound generator. In this case the directivity characteristic is $$\Gamma(\theta, L) = \left|\frac{\sin(\gamma_+(\theta))}{\gamma_+(\theta)} + R_M\right|$$

The factor $R_M$ describes the relation of the maximum amplitudes of the stick radiator and the additional monopole source (Index M) and their phase difference $\phi_M$:

$$R_M = \hat{p}_M(r)/\hat{p}_{max}(r)e^{i\phi_M}.$$

For example cardioid characteristic is possible for L=0.1λ und $c_W = c_O$ and $R_M = 0.9355e^{j\pi}$, whereas the resulting sound pressure level is 23.8 dB less than the sound pressure of the stick radiator. For wave velocities higher than the velocity of sound in the ambient air the stick radiator maximum radiation (main lobe) does not radiate in 0° direction but in direction of the so called "Mach" angle $\theta_{Ma}$ in relation to the waveguide axis $$\theta_{Ma} = \arccos\left(\frac{c_o}{c_W}\right)$$

This formula is true for L→∞. For shorter waveguide the formula is only a estimation. The exact angle can be calculated from the directivity characteristic. For L=λ and $c_W = 2c_O$ results in radiation with maximum amplitude under the Mach angle 60° respective 300° to the waveguide axis. For $c_W^{\infty}$ the stick radiator radiates in phase ("Schallzeile") and the main lobes are in 90° respective 270° to the waveguide axis. Note, the waveguide cannot have a value of infinity for the wave velocity. For wide frequency ranges the same directivity characteristic can be reached if waveguide or transformer have frequency dependent properties, so that for all frequencies can be realized $$\lambda/L = \text{const.}$$

whereas L means the effective spectral radiating waveguide length. Following waveguide length L stands for the effective spectral radiating waveguide length, that can be shorter than the total length of the waveguide. The quasi-/segmented waveguide has a border frequency $f_g$ that depends on the length of the segments $L_i$ (above the border frequency no mechanical waves travel along the waveguide) and is defined as $$f_g = \frac{c_W}{\pi L_i}$$

This effect can be used to realize a frequency independent directivity characteristic, e.g. by varying the segment length or other properties of the waveguide transformer along the waveguide axis. A frequency independent directivity characteristic can be realized also by inserting lowpass (e.g. absorber), highpass or bandpass filter into the waveguide/transformer or by the local spectral damping of the waveguide/transformer. The effective radiating waveguide length can start at any point of the waveguide (e.g. only a section at the end of the waveguide radiates at high frequencies). The forward-backward-relation $\Gamma_{0/180}$ is $$\Gamma_{0/180}(L) = \frac{\hat{p}(\theta = 0°)}{\hat{p}(\theta = 180°)} = \frac{\sin(\gamma(\theta = 0°))}{\gamma(\theta = 0°)} \frac{\gamma(\theta = 180°)}{\sin(\gamma(\theta = 180°))}$$

The isophase planes or curvatures are calculated as (because of symmetry: radius depending on θ)

$$r(\theta) = \frac{L}{2}\left(\cos(\theta) - \frac{c_o}{c_W}\right) + \frac{\phi}{k}$$

whereby φ is the phase angle. Because the term in the brackets is frequency independent, the stick radiator radiates in-phase at all frequencies and at any wave velocity and waveguide length. The isophase planes, (i.e. the curvature and the midpoint of the curvature) can be adjusted by the length and the form of the waveguide, the properties of the transformers and the wave velocity. Adjusting can also be done while radiating.

Waveguides with very short effective waveguide length have isophase planes that are similar to circles as with spheres (free field). With some stick radiators any isophase plane can be realized by superposition of the sound fields. So it is possible to cancel the sound of a noise source from any position of the stick radiator relative to the noise source for a angle section by reproducing the isophase plane of the noise source.

The given formulas and considerations are also valid for the quasi-/segmented waveguide. In the one-dimensional case (duct, cross section area S) the sound pressure of the stick radiator is $$p(r, t) = \frac{\rho_o c_o}{2S}\begin{cases} \int_0^L d\dot{V}\left(x, t - \frac{x}{c_W} + \frac{x}{c_o}\operatorname{sign}(r) - \frac{r}{c_o}\right) & \text{quasi-/homogeneous} \\ \sum_{i=1}^{N} \Delta\dot{V}_i\left(t - \frac{x}{c_W} + \frac{x}{c_o}\operatorname{sign}(r) - \frac{r}{c_o}\right) & \text{quasi-/segmented} \end{cases}$$

The maximum sound pressure amplitude with neglection of damping and with constant volume velocity follows to $$\hat{p}_{\max} = \frac{\rho_o c_o}{2S}\begin{cases} \int_0^L d\dot{V} & \text{quasi-/homogeneous} \\ N\Delta\dot{V}_i & \text{quasi-/segmented} \end{cases}$$

With the function $$\gamma_{\pm}'(r) = \frac{\pi L}{\lambda}\left(\text{sign}(r) \mp \frac{c_o}{c_W}\right) + jL\frac{\beta}{2}$$

the sound pressure can be expressed (quasi-/homogeneous waveguide)

$$p(r, t) = \hat{p}_{\max}\frac{\sin(\gamma'(r))}{\gamma'(r)}e^{j\gamma'(r)}e^{j\omega t - kr}$$

The above given formulas are valid in analogous manner for the quasi-/segmented waveguide/transformer. The formula for the forward-backward relation $\Gamma_{0/180}$ is analogous to the free field case (only γ' instead of γ). The stick radiator radiates in-phase in a duct. The frequency response sound pressure to excitation in the one-dimensional case is $$r(\theta) = \frac{L}{2}\left(\text{sign}(r) - \frac{c_o}{c_W}\right) + \frac{\phi}{k}$$

$$\frac{p}{\Lambda} \sim \omega^{w-2} \quad \text{bzw.} \quad \frac{p}{\Lambda} \sim \omega^{w-1}$$

The formula for the phase planes is analogous to the free field case $$r(\theta) = \frac{L}{2}\left(\text{sign}(r) - \frac{c_o}{c_W}\right) + \frac{\phi}{k}$$

In a duct the phase can be controlled by wave velocity and waveguide length.

If the mechanical waves arrive at the end of the waveguide (x=L) i.e. the mechanical energy has not been changed totally into acoustical radiation or dissipation, then the waveguide has to be terminated by an active or passive impedance termination. The impedance termination has to match impedance of the waveguide $$Z(x=L)=Z_A$$

If the mechanical energy has already been totally changed into acoustical radiation or dissipation, the impedance termination is not necessary. Reflected or standing waves can also be used for adjusting the directivity characteristic, the iso phase planes and the sound pressure amplitude of the radiation. Therefore the amplitude and the phase of the reflected waves must be adjusted with respect to the excitation of the waveguide by the exciter.

The reflection of the mechanical waves is caused by impedance mismatch of the impedance termination $$Z(x=L)\neq Z_A$$

An active impedance termination realizes any impedance and can work as a generator for efficiency improvement. The active impedance termination can also work as second exciter (if necessary with adapter for impedance transformation). Whereas the first exciter causes mechanical waves traveling forward in positive x-direction (index: forward) the second exciter causes excitation of the mechanical waveguide so that mechanical waves travel along the waveguide axis but in backward direction (index: backward). Each exciter reflects or damps the mechanical waves introduced by the other exciter. By this simultaneous directed acoustical radiation, a second directed sound signal is possible. In free field and simultaneous forward and backward operation the sound pressure of superposition of the sound fields results in (harmonical excitation)

$$p_{res}(r, \theta, t) = p_{forward}(r, \theta, t) + p_{backward}(r, \theta, t) = \frac{\rho_o Q_{ges}}{4\pi r}e^{j\omega t - kr - j\omega\frac{L}{2c_W} - \frac{\beta L}{2}}\left(\frac{\frac{\sin(\gamma_+(\theta))}{\gamma_+(\theta)}}{\Gamma_{forward}} + R_{backward}\frac{\frac{\sin(\gamma_-(\theta))}{\gamma_-(\theta)}}{\Gamma_{backward}}\right)$$

with the complex directivity factor $R_{backward}$, that contains the amplitude relation of the sound pressure amplitudes in far field and the phase difference $\phi_{backward}$ and is defined as $$R_{backward} = \left(\frac{\hat{P}_{backward}}{\hat{P}_{forward}}\right)e^{j\phi_{backward}}$$

The directivity factor's influence on the directivity characteristic can be expressed as follows:

$$\Gamma_{res}(\theta,L)=|\Gamma_{forward}(\theta,L)+R_{backward}\Gamma_{forward}(\theta,L)|$$

For short waveguide (e.g. L=λ/3) monopoloide, dipoloide or Cardioid directivity characteristic can be reached by adjusting of $R_{backward}$ according to the values given in FIG. 3. In the one-dimensional case unidirectional, in-phase radiation with any waveguide length and low wave velocity is possible. By simultaneous forward and backward operation in freefield the iso phase planes can be adjusted in analogous manner as by simple forward operation.

The acoustical efficiency of the directed stick radiator can be adjusted by the local waveguide impedance, the properties of the waveguide/transformer and the impedance termination. For each segment the acoustical power can be calculated as (with radiation impedance per unit length $Z'_{ac}$ $$dP_{ak}(x) = \frac{1}{2}Z'_{ak}(x)\dot{\xi}^2$$

with density of air $\rho_o$. Additionally the power that is lost by local dissipation is (with dissipation impedance per unit length $Z'_V$)

$$dP_V(x) = \frac{1}{2}Z'_V(x)\dot{\xi}^2$$

If displacement velocity ξ is supposed to be constant and the dissipation resistances $Re(Z'_{ak})$ and $Re(Z'_V)$ are constant the total mechanical power will be transformed into acoustical power and dissipation power within the waveguide length L* that is defined as $$L^* = \frac{Re(Z(x=0))}{Re(Z'_{ak}) + Re(Z'_V))}$$

Because the displacement velocity is supposed to be constant, the resistance of the waveguide from x=0 to x=L* has to decrease linearly $$Re(Z(x))=Re(Z(x=0))(1-x/L^*)$$

The acoustical efficiency $\eta$ is defined as $$\eta = \frac{Re(P_{ak})}{Re(P_E)} = \frac{Re(Z'_{ak})L^*}{Re(Z)}$$

If the loss of power by dissipation is low in comparison to the losses by acoustical radiation ($dP_{ak} << dP_V$), and the stick radiator has the length L*, the acoustical efficiency approaches $\eta=1$. These considerations are valid for the quasi-/segmented waveguide/transformer in analogous manner.

The directed stick radiator can be used in gaseous or liquid or solid media. The stick radiator can also be used for secondary tasks (e.g. support structure or fluid conduit). Because of the thin design the directed stick radiator can be used for acoustical radiation in small chambers or within small enclosures (cleaning with sound waves), sound can be created very close to surfaces or in corner of rooms, what is important for active noise cancellation. For the purpose of cleaning by sound waves the stick radiator can be used in narrow tubes or in enclosures with small openings. Other fields for usage are manufacturing technology (particle technology), sound location and ultrasonic application with high power output.

In reverse operation mode the stick radiator can be used as directed microphone or vibration detector. Thereby sound waves or mechanical waves are received by the waveguide from the surrounding air. The exciter then operates as a vibration detector that gives voltage or current depending on the acoustical load of the transformer and resulting displacement of the waveguide. Any conventional detector such as electrostatic, electromagnetic or piezoelectric transducers would function as a detector is as is apparent from the Figures.

Other objects and aspects of the invention will become apparent from the following descriptions of embodiments with reference to the accompanying drawings:

BRIEF DESCRIPTION OF THE DRAWINGS

FIG. 2 is a tabular summary graphically illustrating the relationship of volume velocity with the displacement of the homogeneous or segmented waveguide.

FIG. 3 is a tabular summary of examples of the directivity characteristic of the stick radiator having an active impedance termination for a waveguide length.

Figure 15:
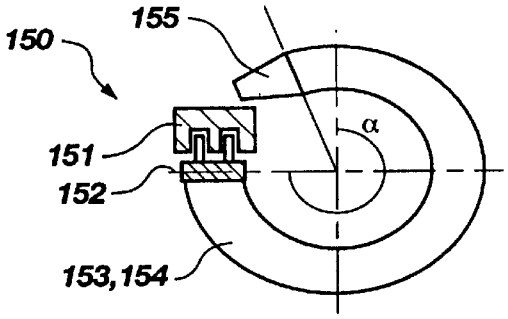
FIG. 15 shows a stick radiator having a ring configuration.
Figure 16:
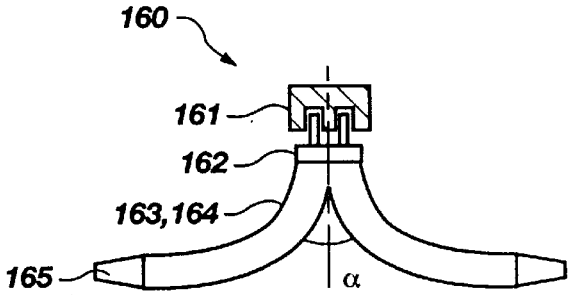
FIG. 16 discloses a stick radiator with split waveguide.

For all figures the following terms and component numbers are valid (the corresponding figure number has to be inserted for x): x0 stick radiator, x1 exciter, x2 adapter, x3 waveguide, x4 transformer, x5 impedance termination, x6 and x7 other parts to be specified, e.g. housing etc. In other words the waveguide portion in FIGS. 15 and 16 are identified as 153 and 163 respectively. Within the description of a single figure the component numbers are given only at the first time of appearance.

DETAILED DESCRIPTION OF THE PREFERRED EMBODIMENTS

The basic concepts of the present invention provide methodology and mechanisms for coupling mechanical vibrations efficiently from a mechanical exciter or source and transmitting them to a waveguide which includes mechanical structure comprising acoustical transformers for coupling this energy into air, fluids or solids. This combination is graphically represented in FIG. 1 comprising an actuator or exciter 11, and adapter 12, a waveguide 13 which includes a series of transformer elements (not shown) contained within the waveguide, and a termination element for controlling vibrational energy which has passed through the waveguide and attached transformer elements.

Figure 1:
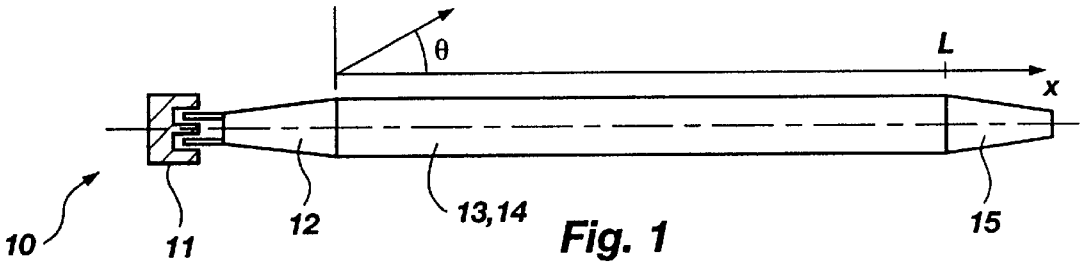
FIG. 1 is a side, plan view of a directed stick radiator.

The exciter 11 can be any mechanical vibrator, oscillator or other source which generates mechanical wave energy. This would include piezoelectric transducers, electrostatic and magnetic emitters, mechanical vibrators, etc. The important criteria for the exciter is that it is able to generate mechanical energy that can be coupled to an adapter for transmittance to the waveguide. The adapter comprises a horn or other intermediate body which carries this vibrational energy efficiently between the exciter and waveguide. FIG. 1 shows a horn-type structure having an increasing radius which merges with the waveguide 13.

As will be noted form the following description of examples, the waveguide and transformer structure cooperatively interact to move vibrational energy along a given length of material which is specifically configured to provide efficient transfer of mechanical energy from the waveguide into acoustical transformer elements or sections which interface with air or the surrounding environment. The waveguide may typically be formed of metal or other material with good vibration transmittance. Generally, the waveguide has a mass and shape which effectively passes mechanical energy, but does not significantly convert that energy to sound. This preference for energy transmittance versus generation of acoustic output occurs because the waveguide is not shaped to efficiently couple with the air for displacement of sufficient air volume to develop acoustical sound response. Rather, it functions to conduct energy to distinguishable transformer elements to perform this important function. Conceptually, the present invention provides mechanical energy transfer by small movements within the waveguide, with coordinated conversion of such small movements to displacements of other surfaces comprising the transformer elements. This has proven to develop a surprisingly efficient speaker system for developing acoustical output with significantly reduced energy losses.

The transformer elements provide mechanical structure for receiving this mechanical energy from the waveguide and, because of a larger surface area configured for enhanced surface-to air-coupling, mechanical energy is converted to radiated sound. The specific design of many embodiments disclosed herein provide for highly directional sound, an achievement which has not been commercially realized in previous speaker systems which directly generate sound in the low and midrange frequencies of the audible spectrum. Furthermore, the structural configurations illustrated provide for improvements in energy efficiency as measured by the percent of mechanical energy which is actually converted to useful acoustic output.

It will become apparent to those skilled in the art, that a key feature of the present invention is the acoustic transformer structure which may be integrally formed with the waveguide, or may be separately coupled to the waveguide body. In accordance with the numerical protocol discussed above, the transformer is identified by linking the figure number with the base number 4. Accordingly, transformer elements in FIGS. 4 through 8 are represented by 44, 54, 64, 74 and 84. This pattern is also followed for the other elements set forth above for the exciter (41, 51, 61, 71, and 81), the adapter (42, 52, 62, 72, and 82), the waveguide (43, 53, 63, 73, and 83) and the terminator element (45, 55, 65, 75, and 85). The correlation of reference numerals is consistent throughout all the embodiments or the various figures. For simplification, further reference to a repeated structure will be identified by the specific structure (item 42) and a general reference (x2) wherein the "x" represents all of the figure numbers corresponding to various embodiments, and "2" refers to the appropriate structural component (i.e. the adapter). Therefore, the emitter or directed stick radiator is identified by (10, x0) and refers to the specific radiator of FIG. 1, but corresponding radiators of the other figures as well.

In FIG. 1, for example, the exciter (11, x1) introduces mechanical power by an adapter (12, x2) into the waveguide (13, x3). Mechanical waves travel along the waveguide and cause local displacements that are transformed into sound pressure by separated or integrated mechanical acoustical transformer (14, x4) which are coupled to the waveguide. The waveguide may terminated by an active or passive impedance termination (15, x5). The term "local" with respect to displacements, impedance or other properties of the waveguide or transformer refers to a small section (i.e., the properties at coordinate x or at the "i"th alignment of waveguide or transformer. A local displacement might be the displacement of the smallest segment or area of the waveguide. It is the area in which physical properties of the waveguide can be varied to develop a desired response.

Whereas FIG. 1 represents a generic, graphic illustration of the radiator components, the following figures show specific embodiments, with a general emphasis on the variety of transformer configurations possible, with various waveguide constructions. For example, FIG. 2 illustrates the relationship of the order w of the transformer with respect to possible realizations of the waveguide (x3) and the transformer (x4). The corresponding volume velocities with respect to volume strokes are presented, with the following monopole source terms and transformer functions. There are examples given for the segmented and homogeneous waveguide/transformer. Items b) and d) represent prior art relationships occurring in homogeneous waveguides. In the last row the equations are shown for the local volume acceleration $d\ddot{V}$ or $\ddot{V}_i$ are given for the quasi-/segmented waveguide/transformer. Following the realizations are described:

a) The longitudinal displacements of the segmented waveguide (23*a*) with openings, that is placed above the duct (24*a*) with openings as part of a pressurized duct, causes a modulation of the cross section of the openings that are on top of each other. The transformer 24 is a combination of two moving openings developed by relative movement of the waveguide to the duct transformer.

b) The transversal displacements of the homogeneous waveguide (23*b*) modulates the slit of the duct (24*b*). An air stream flows in analogous manner to a) through the local modulated slit.

c) The waveguide (23*c*) consists of a series of diaphragms, each with surface area A, that are connected by springs. The diaphragms of the waveguide are enclosed by the transformer housing (24*c*) to avoid hydrodynamical short circuit (without the housing, dipole radiation would occur). The springs leave the transformer housing on the reverse side through holes that are acoustically sealed. Because of the displacement of the diaphragms, volume displacement is caused. The stiffness of the mechanical spring and the stiffness of the enclosed air result in a total stiffness for the system generally. For example, if a steel wire is used as a spring, its stiffness is much higher than the stiffness of the enclosed air. The volume of the housing can be minimized so that only the displacement of the piston is to be considered. The diaphragm may be very stiff and can be made from hard materials such as sheet metal. In order to adjust the wave velocity and/or the local impedance of the waveguide, variations can be made in the weight of the diaphragm or piston, the weight of the wire of a single segment, the length of the segment, the cross section of the wire, the density of the wire and the modulus of elasticity of the wire.

d) The homogeneous waveguide/transformer (23*d*, 24*d*) consists of a flexible foil of width B. Transversal waves travel along the foil. The displacement of 23(*d*), 24(*d*) cause volume displacement.

e) The homogeneous waveguide/transformer (23*d*, 24*e*) consists of diaphragms or pistons with local area A, that are connected with a rigid bar on the right side with an housing. On the left hand side the pistons are connected with the next housing by a spring. The volume displacement is proportional to the displacement of two adjacent elements. Also the air stiffness can be used alone without an additional spring. Therefore the enclosed air volume has to be reduced significantly. This embodiment is particularly useful with ultrasonic energies, as can be seen from the volume acceleration formula.

f) Quasi-longitudinal waves are illustrated traveling along the homogeneous waveguide/transformer (23*f*, 24*f*). Because of the perpendicular displacements of adjacent sections, lateral contraction and expansion is caused corresponding to the Poisson ratio. The lateral displacements of a section dx multiplied with the cross section of the waveguide A and the Poisson ratio results in the volume displacement. This waveguide needs no housing for acoustical radiation g) This section sets forth the general equations applicable to the given examples a) to f). These equations provide for calculation of the local change of volume acceleration of the quasi/homogeneous and quasi/segmented waveguide.

FIG. 3 illustrates a table showing the directivity characteristics of a stick radiator (x0) with the effective radiating waveguide length $L=0.3\lambda$ and the waveguide velocity $c_w=c_O$. The active impedance termination (x5) works as a second exciter. The directivity characteristics are shown for forward radiation ($\Gamma_{forward}(\theta)$) and backward radiation ($\Gamma_{back}(\theta)$) and the superposition of forward and backward radiation ($\Gamma_{res}(\theta)$). According to the directivity factor R monopoloide or dipoloide or cardioide radiation is achieved.

Figure 4:
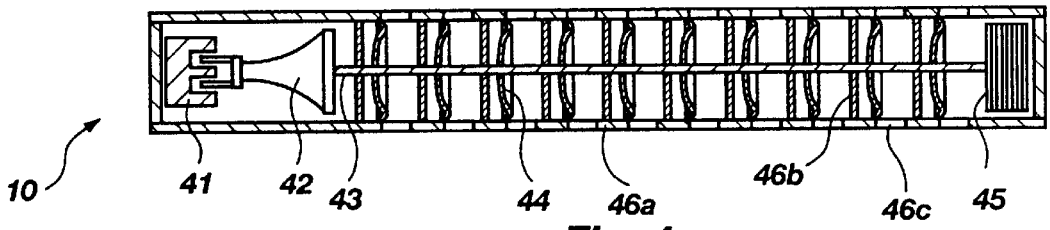
FIG. 4 graphically illustrates a cross-sectional view of one embodiment of a segmented stick radiator including a horn adapter, longitudinal waveguide, piston, and block absorber.

FIG. 4 identifies a stick radiator (40) which has an electrodynamic exciter (41) coupled with a horn as an adapter (42) to the segmented longitudinal waveguide (43). The waveguide consists of a stick or wire with pistons, diaphragms, or membrane referred to hereafter as "piston") as transformer elements (44) fixed on it. With the displacements of the waveguide, the pistons are also displaced and cause volume displacement. In order to avoid acoustical short circuit between the front and the back side of the piston, the pistons are flexibly fixed and respectively made tight to the duct wall (46*a*) and the backward enclosure is terminated by rigid, fixed plates (46*b*) that have a opening, through which the waveguide is introduced. This opening is sealed and also serves as a pressure compensation opening. The enclosed volume between the plates and the piston can be very small if the stiffness of the air is small in comparison to the stiffness of the waveguide. The stiffness of the air can be used, if the enclosed volume behind the piston is very small. The enclosed volume can also be filled with rubber or similar material. In this embodiment, the piston is also part of the waveguide (43), because its mass, stiffness and damping influence the wave velocity. Sound leaves the duct (46*a*) through openings (46*c*) in front of the pistons. The piston, the rigid plates and the openings can be build as acoustical networks or integrated acoustical networks for manipulating the sound radiation. Also compensation openings within the piston or the plates or the duct can be used as acoustical networks.

The decrease in displacement of the traveling mechanical waves by radiation damping and dissipation are compensated by waveguide properties which are variable with distance x and/or transformer function being variable with distance x, e.g. with a waveguide impedance that exponentially or linearly decreases or a increases with the radiating area. The impedance termination of the waveguide is a block absorber (45), consisting of several layers with different stiffness, damping and inertia. For realization of a frequency independent directivity characteristic the above mentioned ideas can be used and also the openings and the enclosed volumes in front of the piston can be designed for this reason e.g. different size of openings, additional membranes on the openings, tubes of different length in front of the opening or other known acoustical networks.

The openings should be minimized or partly/totally shielded with foil or lattices for protection and decoupling against dirt, water, damage, mechanical, climatical and/or chemical influences or for other tasks. The whole stick radiator or pieces of it can be thermally decoupled or cleaned by a air stream or a water stream. For direct radiation in a duct, the stick radiator can be put into the duct or be part of duct structure or be attached near to the duct, whereby sound is emitted directly through the openings or through additional connecting tubes.

Figure 5:
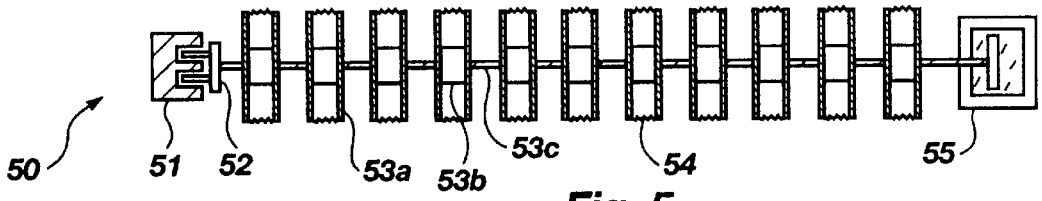
FIG. 5 graphically illustrates a cross-sectional view of one embodiment of a segmented stick radiator, including a longitudinal waveguide, bending plates, discs with lever effect for increasing the volume velocity, and viscosity damper as impedance termination.

FIG. 5 The segmented waveguide/transformer (53) consists of elastic caps or plates (53*a*), rigid spacer rings (53*b*) and rigid spacer sticks (53*c*). By the pressure of a spacer stick on the one side of a single plate and the reacting pressure of a spacer ring on the other side at a different position on the plate, the plate bends. Because of the principle of levers, the displacements of the outer edge of the plate are bigger than the displacements in the middle of the plate. Every two adjacent plates that are separated by a spacer ring are connected by a surrounding rubber as transformer (54) at the edge. The bending displacement caused by the difference in displacement of two adjacent plates, changes the volume that is enclosed between the neighboured plates. The waveguide is terminated by a viscosity damper as impedance termination (55). Because the waveguide uses bending springs, big displacements at the edge are possible. Because of the low displacement of the bending springs they act linearly.

Figure 6:
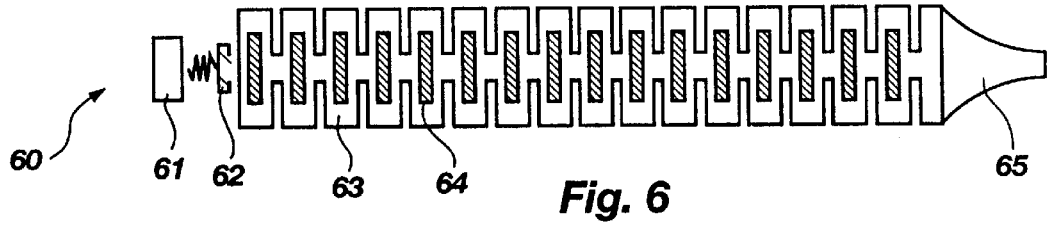
FIG. 6 graphically illustrates a cross-sectional view of one embodiment of a quasi-segmented stick radiator including a mechanical vibration exciter, slit with lever effect and horn impedance termination.

FIG. 6 shows an exciter (61) used as a mechanical vibration exciter consisting of a mass and a spring. The quasi-segmented waveguide (63) consists of a slit spring. Because of the slits 67, the wavevelocity decreases. As with transformer (64) the slits may be alternately covered with foil or filled with soft foam rubber. By the difference of the displacements of adjacent slits the enclosed volume changes and sound radiation follows. The impedance termination (65) is a horn with a high dissipation factor. Because of the simple design (one single component) slit springs are very robust, simple to dimension and easily to recycle.

Figure 7:
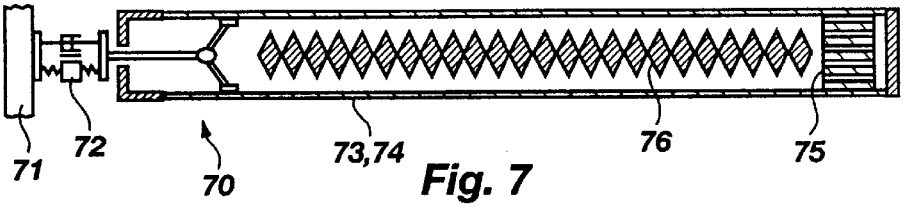
FIG. 7 graphically shows a cross-sectional view of a homogeneous stick radiator utilizing a vibrating wall as exciter, transversal waveguide and cross block absorber.

FIG. 7 illustrates an exciter (71) serving as a vibrating source e.g. a vibrating wall or surface. The adapter (72) consists of a mechanical network of springs, mass and dampers, that are used to manipulate the relative phase between the radiated sound of the vibrating source and the stick radiator. The adapter changes the excitation (longitudinal into transversal movement). By the adapter two homogeneous waveguide/transformers (73) are excited, that consist of a plate or a foil. According to the bending stiffness of the waveguide/transformer the transversal waves or bending waves travel along the waveguide. As impedance termination (76) a block absorber is used which is installed transversally so both waveguides damp each other. The enclosed volume between the two waveguides is filled with absorbing material and/or with a gas with high sound velocity (e.g. helium) to avoid acoustical reaction by the radiation inside, by standing waves or by mutual excitation of the waveguides.

Figure 8:
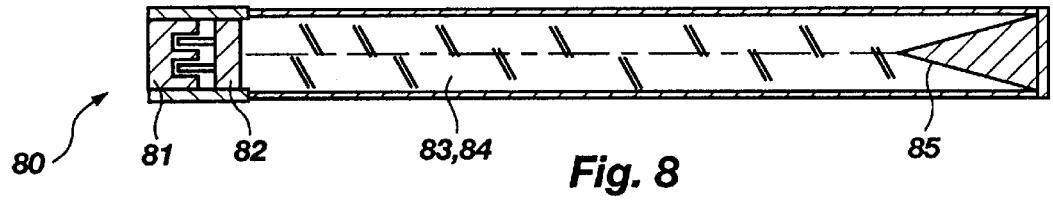
FIG. 8 graphically depicts a homogeneous, hydraulic quasi-longitudinal waveguide with a damping wedge as impedance termination.

In FIG. 8 the adapter (82) consists of a piston. The homogeneous quasi-longitudinal waveguide/transformer is a tube respectively a flexible duct, that is filled with a liquid.

By the excitation with the piston quasi-longitudinal waves travel along the waveguide/transformer. The surface of the tube expands because of the volume constant of the liquid, what causes volume displacement and therefore sound radiation. The wave velocity can be adjusted by the thickness of the tube, the inner cross section, the material, the inside pressure, the gas concentration in the liquid and the density of the liquid. The impedance termination (85) is a $\lambda/4$ absorbing wedge, that is mounted at the waveguide end and is directed towards the exciter (81). In analogy to the impedance termination, the waveguide can also cause a turn around of the direction of travel for the mechanical waves.

Figure 9:
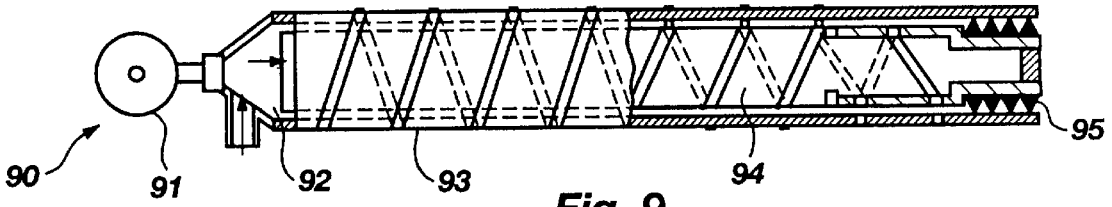
FIG. 9 illustrates a quasi-homogeneous stick radiator with excitation by a rotating unbalanced driver pneumatically supported transformer and friction damper.

FIG. 9 illustrates a stick radiator which has an unbalanced exciter (91). Additionally it is pneumatically supplied with compressed air. The adapter (92) excites the quasi-homogeneous waveguide with slits (93) and supplies the transformer with compressed air (94). According to the relative displacement of the slits, air moves outward through the openings of the transformer and the waveguide. The outlet velocity depends on the displacement, the time and the inside pressure. The impedance termination (95) comprises a friction damper. The outflow of the compressed air corresponds to the setting free of secondary energy. Also mechanical, hydraulical, thermical or other kinds of energy can be set free. For high sound power, expanding combustion gases or water steam can be used.

Figure 10:
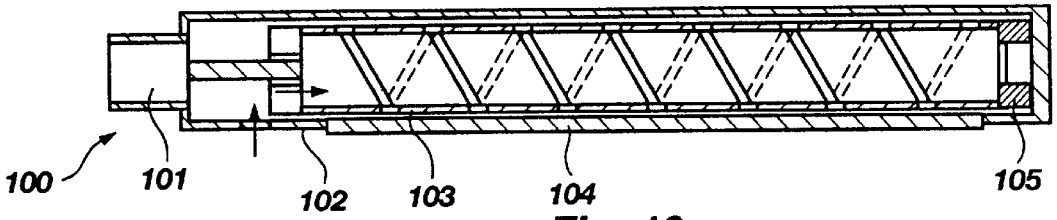
FIG. 10 shows a quasi-homogeneous, pneumatically supported stick radiator having a rotating shaft as a waveguide.

In FIG. 10 a torsion exciter (101) excites a homogeneous spiral slit rotor as a quasi-homogeneous waveguide (103). By rotation of the rotor the spiral slits travel as mechanical wave with wave velocity $c_W$ along the waveguide axis. Below the rotor the transformer with housing (104) has a slit opening. The rotation of the rotor causes displacements that modulate the common opening of waveguide and transformer. The waveguide has as impedance termination comprising a bearing, that holds it. Instead of a rotor, other structure can be used such as a piston drive, cam drive, chain drive, gearwheel drive, rotation drive, etc.

Figure 11:
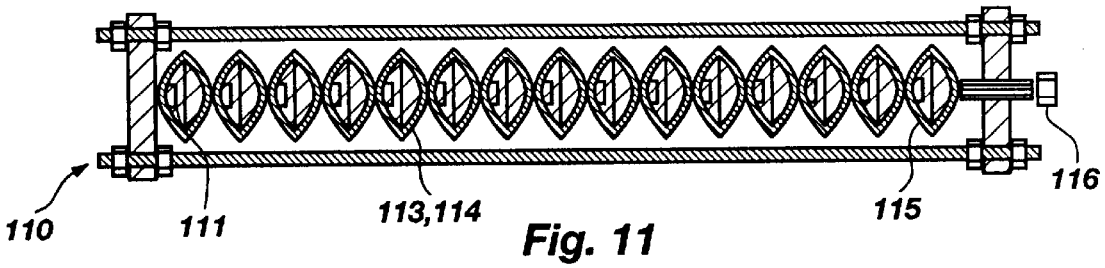
FIG. 11 depicts a segmented stick radiator, piezoelectric exciter, plate spring transformer element or bending transformer element formed as a lentil (bot) lens as a waveguide/transformer, adjusting device.

In FIG. 11 the segmented waveguide (113) consists of bending elements. Piezo actuators (111) serve as exciters that are fixed in or at the segments. The waveguide can be excited by a single or many actuators, operating within one or more sections simultaneously or with time delay. Because many actuators excite, only low power is necessary to drive the waveguide.

The exciters may also serve other purposes. They can damp mechanical waves at the end of the waveguide, or adjust the wave velocity (at higher voltage the waveguide gets stiffer). The exciter can excite the waveguide at both ends or from the middle. The impedance of a single segment can be adjusted by use of a feedback or feedforward circuit of the displacement or the velocity or the acceleration. By the frame and the tensioning device (116) the wave velocity and/or the length of the waveguide are adjusted. If mechanical waves arrive at the waveguide end, the mechanical waves travel back along the frame as another waveguide/transformer to the beginning of the main waveguide, where they are introduced or actively cancelled by the exciter. Secondary sound pressure can be simultaneously recorded by the piezo actuators as a directed microphone, which allows a sound cancellation without additional microphones.

Figure 12:
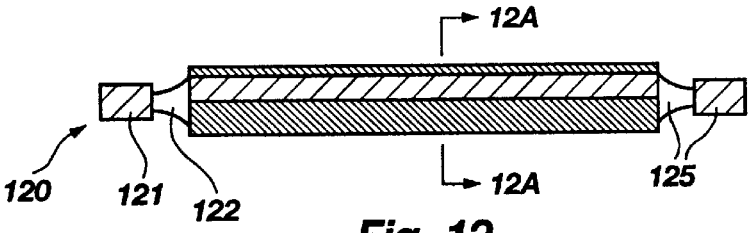
FIG. 12 shows a side graphic view of a homogeneous stick radiator, with a torsion waveguide.
Figure 12A:
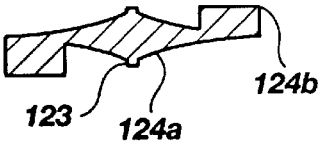
FIG. 12A represents a sectional drawing taken along the lines A—A of FIG. 12.

In FIG. 12 the torque exciter (121) excites by a horn adapter (122) the homogeneous torsion waveguide (123). Longitudinal exciters can also be used with a mechanical network (lever). As transformer the torsion waveguide has wings (124*a*), that has one side covered with foam rubber (124*b*) and a plate (124*c*) to avoid hydrodynamical short circuit. For this purpose the torsion waveguide can also be enclosed by a housing. The waveguide has an active impedance termination that consists of an hornadapter (125*a*) and an exciter (125*b*). The second exciter excites also the waveguide. Both exciter excite and realize any impedance termination desired. By this way the directivity characteristics in FIG. 3 can be achieved.

Figure 13:
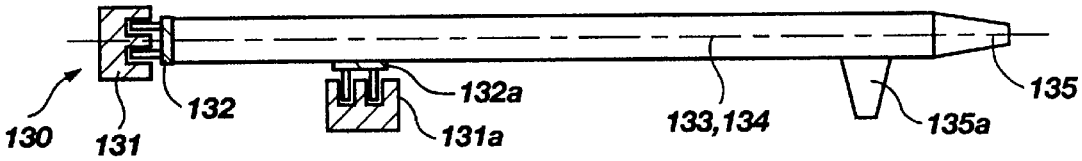
FIG. 13 graphically illustrates a stick radiator with polarized excitation and damping.

FIG. 13 shows two exciter elements (131, 131*a*) operating with an adapter (132, 132*a*) on the waveguide/transformer (133, 134) independent of each other, and also at different locations. By these two different wave types, longitudinal/transversal or polarized waves travel along the waveguide axes. This excitation structure can also serve as impedance termination (135, 135*a*).

Figure 14:
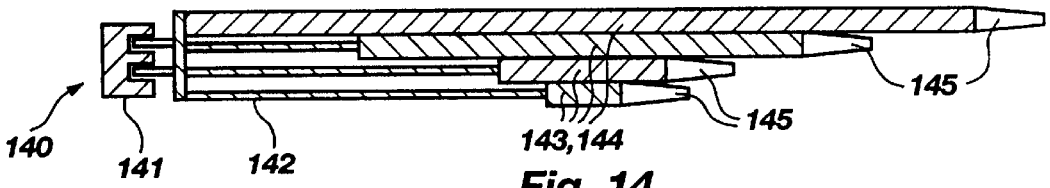
FIG. 14 depicts a multi-stick radiator with length compensation and frequency response.

With FIG. 14 an adapter (142) with length compensation, phase shift and/or frequency switch simultaneously excites four waveguides (144). The single waveguides are positioned in such a way, that the mid of the waveguides (L/2) are laying all in the middle on the drawn vertical line. By coordinating the length difference and the additional phase shift of the adapter, all waveguides may act at the vertical line with the same phase and therefore all waveguides radiate in the far field with the same phase. If all waveguides are driven with the same frequency, by Chebyshev weighting or other known weightings of sound pressure, amplitude or -phase or the distance between the single waveguides or by the position and direction of the waveguides in the space, an additional directivity characteristic is accomplished with a high ratio between the sound pressure of the main lobe and the side lobes according to the „Theory of Shaded Transducer Arrays"bzw. "Beam Forming".

FIG. 15 illustrates a stick radiator (15) with a waveguide/transformer (153, 154) with circular form which has a directivity characteristic that depends on the circular angle $\alpha$. At high wavevelocities the waveguide radiates like a double piston. If the cross diameter of the circular form is small in comparison to the wavelength nearly monopole radiation follows. The waveguide/transformer can also be build as a plane or spacial spiral (axis vertically to the paper plane). The spacial spiral transforms the wavevelocities corresponding to the diameter and the gradient of the spiral. The stick radiator can also have simple wave form. The circular or spiral or otherwise formed stick radiator can be attached to rotating components (e.g. vehicle wheel, engines) or be used as ceiling speaker.

In FIG. 16 the waveguide/transformer (163, 164) splits into two waveguides/transformers. If a large number of waveguides/transformers is radially positioned, ideal monopole radiation is reached. As matter of principle each point of the waveguide/transformers can be the starting point of additional waveguides.

Figure 17:
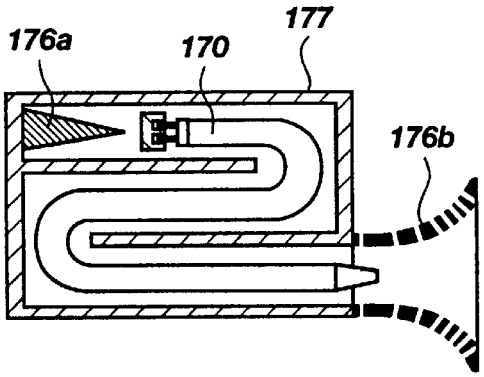
FIG. 17 gives a sectional view of a stick radiator in a folded housing, and having a wedge absorber and punched horn.

FIG. 17 shows a stick radiator (170) that is placed inside a duct or other housing. There is a huge influence of the housing on the directivity characteristic. If the whole stick radiator extends within the duct to the impedance termination, ideal monopole radiation follows. The duct can also be short or have two openings, or can cover only a part of the waveguide. To install the stick radiator in a housing, the stick radiator can be folded or bent at any angle (e.g. at 180°, if two waveguide ends are fixed at the same side of a plate). All known resistive or reactive elements such as Helmholtz resonators, $\lambda/4$ resonators, acoustical lenses, (parabol-) reflectors, rings, plates or hollow cones or silators can be positioned at the waveguide/transformer. In the shown housing the waveguide is folded. To enable the sound to leave the housing, the duct has a wider cross section than the waveguide/transformer. For adapting the impedance of the duct to the ambient air an acoustical horn is used (176*b*). Towards the ambient air the horn has an increasing number of little holes (shown only in cross cut) to avoid reflections. The duct/housing is terminated with a wedge absorber to avoid standing waves. For influencing the directivity characteristic, a part of the waveguide/transformer extends out the opening of the housing. The housing may serve other functions such as decor, wherein its configuration is as furniture, a lamp, wall element. It can also be integrated into other objects, and/or be designed with flexibility (tube).

Figure 18:
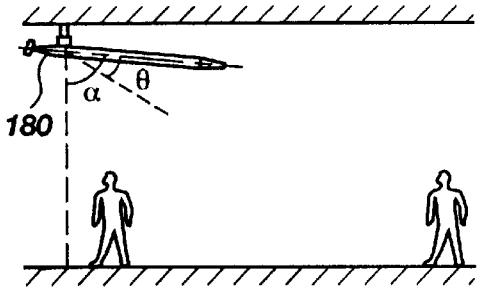
FIG. 18 graphically illustrates a stick radiator for sound reinforcement with constant sound pressure level at different distances.

FIG. 18 illustrates use of the stick radiator (180) which is movably mounted at a ceiling or bar and with angle $\alpha$ inclined to the vertical. This construction offers unique advantages with directional control of the propagated sound. By its directivity characteristic and the adjusting of angle $\alpha$, a wide distance with a desired (e.g. equal) sound pressure level can realized (e.g. platforms in a railway station, stadium, concerts, crowds). If the stick radiator is positioned at a wall or a corner, as shown in the figure, the reflections can be used acoustically or avoided by the directivity characteristic or to avoid by known acoustical methods.

Figure 19:
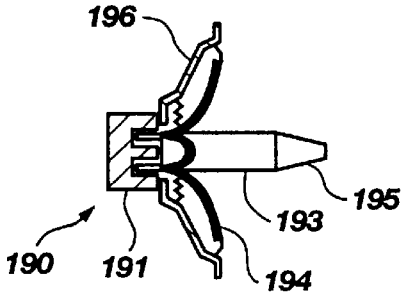
FIG. 19 illustrates a stick radiator, and electrodynamical exciter with transformer.

In FIG. 19 the stick radiator (190) has as transformer (191) a membrane, that is at beginning of the waveguide, at the position x=0. The displacements of the membrane correspond to the displacements of the waveguide. The system has constant input impedance, no cut-off frequency and radiates with all frequencies in phase. In addition, the membrane may be enclosed by a housing (196) to avoid the hydrodynamical short cut. Because the waveguide has no lower border frequency, the enclosure volume can be small. A waveguide can be coupled to an existing oscillating sound generator of the prior art with a non linear frequency behavior (e.g. electrodynamical loudspeaker) do develop the response of FIG. 19 above. If a quasi-/segmented waveguide is used its border frequency or a mechanical network can be used to cut the frequency response at high frequencies with nearly linear phase response (low pass). By using a network with adapter (e.g. a mass) also a lower cut off frequency can be reached (high pass) and/or the gradient of the amplitude response influenced. The above mentioned measures replace the known phase changing electrical and electronical devices.

Figure 20:
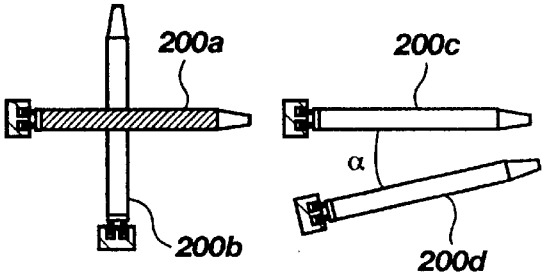
FIG. 20 shows and arrayed arrangement of radiators.

FIG. 20 shows an array arrangement of stick radiators (200*a, b, c, d*). With crossed stick radiator (200*a*, 200*b*) quadruple directivity or a very sharp directivity characteristic is reached. By using parallel arrangement, or by positioning radiators with angle $\alpha$ (200*c, d*) the directivity characteristics get sharper (having a narrow main lobe) similar to an in-phase line array. If the stick radiators are positioned one after another (200*a, c*) and are driven with a time delay corresponding to the velocity of sound in air, the effective radiating length of the waveguide increases and at deep frequencies, directed radiation can be realized. With three orthogonally positioned stick radiators for a given angle section, any directivity characteristic and iso phase plane is reached. For stereo music devices there are minimum of two separated waveguides that emit in different directions, wherein sound reflections from walls reach the a listener's ears with stereo effect.

Figure 21:
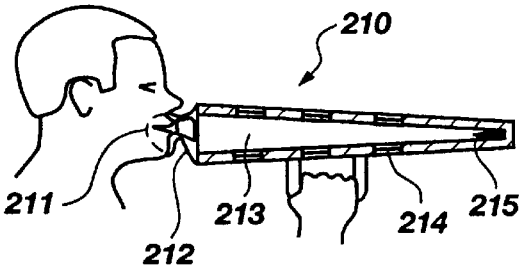
FIG. 21 demonstrates use of a human voice as exciter, air as waveguide and wedge absorber.

In FIG. 21 a stick radiator (21) is used for directed speaking. The exciter (211) is the human voice. A mouthpiece is used as the adapter (212). Alternatively, an exciter can be used to electrically increase the speech signal. The waveguide (213) comprises air enclosed by the housing (216). The sound waves travels along the waveguide and excite membranes that are integrated in the housing and that serve as transformers (214). The cross section of the waveguide decreases slightly so that despite loss of radiation, the intensity in each waveguide cross section is the same. At the end of the housing a wedge absorber non-reflectionally terminates the air waveguide.

Figure 22:
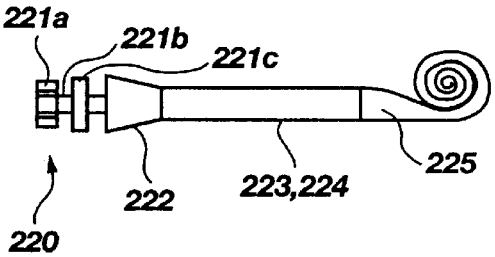
FIG. 22 depicts a stick radiator for high sound pressure levels including a lifting magnet as exciter and horn as impedance termination.

FIG. 22 provides a stick radiator (220) used for producing high sound power levels. The exciter (221*a, b, c*) comprises a Hubmagnet or similar structure. This consists of a cylindrical coil (221*a*), with a long iron stick inside (221*b*). An iron ring is put over the iron stick (221*c*). If the cylindrical coil has a electrical current, the iron ring is accelerated in known manner and hits the horn adapter (222) which transforms the impulse into different frequency ranges corresponding to the elasticity of the adapter material. As homogeneous waveguide/transformer (223, 224) is a homogenous stick (e.g. rubber). The impedance termination comprises a long, spiral clamped horn.

We claim:

1. An elongate acoustic emitter for emitting acoustic energy which is in-phase and directional, said device comprising:

an exciter member having a mechanical wave propagation source;

an elongate waveguide comprised of material configured with a shape which provides a transfer medium for mechanical waves generated by and received from the exciter member, said waveguide being coupled to the exciter;

a plurality of transformer elements disposed along the waveguide, each transformer element being mechanically coupled to the waveguide and have a structure which is distinguishable from structure of the waveguide because of differences in (i) acoustical shape, (ii) material composition (iii) structural orientation, (iv) three dimensional complex impedance or (iv) any combination of acoustical shape, material composition structural orientation, three dimensional complex impedance combined, each transformer element having an acoustical shape configured to convert mechanical energy received from the waveguide into acoustical output in a surrounding medium, at least one of the transformer elements being configured in combination with the waveguide for emitting monopole, acoustic radiation; and means for impedance termination acoustically coupled to the waveguide for minimizing reflection of forward traveling waves propagated along the waveguide.

2. An emitter as defined in claim 1, wherein the transformer elements include at least one spectral, complex acting transformer including structure that moves in a complex manner with respect to transferred motion from the coupled waveguide motion.

3. An emitter as defined in claim 1, wherein the transformer elements include at least one spectral transformer including structure for developing damping of mechanical energy within the combination of waveguide and transformer elements.

4. An emitter as defined in claim 1, wherein the transformer elements include at least one spectral transformer including structure for developing storage of mechanical energy within the combination of waveguide and transformer elements.

5. An emitter as defined in claim 1, wherein the mechanical energy within the waveguide and transformer elements embodies a spectral wave velocity associated with complex frequencies.

6. An emitter as defined in claim 1, wherein the transformer elements are disposed continuously along at least a segment of the waveguide.

7. An emitter as defined in claim 1, wherein the transformer elements are disposed substantially continuously along the waveguide.

8. An emitter as defined in claim 1, wherein the transformer elements are disposed discontinuously at separated points along the waveguide.

9. An emitter as defined in claim 1, wherein the configuration of transformer elements with the waveguide is structured for monopole output as dominant acoustic radiation.

10. An emitter as defined in claim 1, wherein at least one of the transformer elements comprises structure which is physically moveable with respect to the waveguide.

11. An emitter as defined in claim 1, wherein at least one of the transformer elements is fixed in position with respect to the waveguide.

12. An emitter as defined in claim 1, wherein the transformer elements develop the conversion of mechanical energy to acoustic output in part by structure which provides relative movement of the waveguide and transformer elements.

13. An emitter as defined in claim 1, wherein the transformer elements include a lever mechanism for redirecting amplitude and phase of displacement of the coupled waveguide.

14. An emitter as defined in claim 12, wherein the relative movement is accomplished by structure which generates physical movement of at least one of the transformer elements.

15. An emitter as defined in claim 1, wherein the waveguide elements comprise a series of masses which are respectively separated by a spring means.

16. An emitter as defined in claim 1, wherein the acoustical output of the transformer includes secondary energy with respect to mechanical energy generated directly by the exciter.

17. An emitter as defined in claim 16, wherein the waveguide includes structure for controlling the rate of generation of the secondary energy propagated by the transformer elements.

18. An emitter as defined in claim 1, wherein the acoustical output of the transformer comprises tertiary energy which is derived independent of mechanical energy developed in the waveguide.

19. An emitter as defined in claim 1, wherein the waveguide and transformer elements are coupled in fixed relationship.

20. An emitter as defined in claim 1, wherein the waveguide includes structure having a local impedance which is controlled by ambient environmental conditions.

21. An emitter as defined in claim 1, wherein the waveguide and coupled transformer elements include mechanical means for converting local displacement of the waveguide into local volume acceleration of the transformer elements in accordance with the following relationship:

For a quasi-homogeneous or homogeneous waveguide structure $$d\ddot{V}(x,t)=W(x,\omega,t,\xi(x))\xi^{(n\bullet)(m')}(x,t)dx$$

For a quasi-segmented or segmented waveguide structure $$\ddot{V}_i = \ddot{V}_{i^*+m/2}(t) = W_i(\omega, t, \xi_i)\sum_{j=0}^{m}(-1)^j\binom{m}{j}\xi^{(n\bullet)}_{i^*+m-j}(x, t).$$

22. An emitter as defined in claim 1, wherein the mechanical means is selected from the group consisting of mechanical surfaces, mechanical networks, pneumatical actuators, and hydraulic actuators, mechanical volumes and closed volumes.

23. An emitter as defined in claim 1, further comprising a physical enclosure surrounding the transformer elements to prevent hydrodynamical shortcut of the acoustic output and provide structural protection to the emitter.

24. An emitter as defined in claim 1, wherein the transformer elements are selected from the group consisting of a gas spring, a compressible polymer material, a flexible diaphragm, a tube, a mechanical spring, a compressible array of diaphragms, a torsion bar, a bending bar, masses, rigid plates, a wing, a horn, a slotted array, a liquid volume, and any linear array of cavities.

25. An emitter as defined in claim 1, wherein the transformer elements are configured to develop a combination of monopole and dipole acoustical radiation output.

26. An emitter as defined in claim 1, wherein the transformer elements are configured to develop cardioid acoustical radiation output.

27. An emitter as defined in claim 1, wherein the exciter is selected from the group consisting of an electrodynamical actuator, an electrical transducer, a mechanical emitter, a pneumatic emitter, a thermal emitter, and an hydraulic emitter.

28. An emitter as defined in claim 1, further comprising a plurality of exciter placed along the waveguide.

29. An emitter as defined in claim 1, comprising at least two exciters positioned at opposite ends of the waveguide.

30. An emitter as defined in claim 1, further comprising an additional exciter positioned at an intermediate location along the waveguide for developing polarized vibration propagation within the waveguide.

31. An emitter as defined in claim 1, wherein the exciter includes means for adjusting local impedance within the waveguide.

32. An emitter as defined in claim 1, wherein the exciter includes means for adjusting local wave velocity within the waveguide.

33. An emitter as defined in claim 1, wherein the means for adjusting local impedance within the waveguide comprises a forward or backward loop of local displacement.

34. An emitter as defined in claim 1, wherein the exciter includes means for predistorting an input signal to compensate for variations in frequency response of the waveguide or transformer elements.

35. An emitter as defined in claim 1, further comprising an adapter coupled at a first end to the exciter member and at a second end to the waveguide, said adapter being comprised of material and configured with a shape which provides efficient transfer of mechanical waves received from the exciter member and transmitted into the waveguide.

36. An emitter as defined in claim 35, wherein the adapter includes at least one impedance transforming means selected from the group consisting of horns, pneumatic structures, hydraulic structures, damped structures and mechanical structures.

37. An emitter as defined in claim 35, wherein the adapter comprises at least part of the waveguide.

38. An emitter as defined in claim 35, wherein the adapter includes means for distributing mechanical energy in at least two different directions.

39. An emitter as defined in claim 35, wherein the adapter includes support structure to enable attachment to a support device for stabilizing the emitter at a desired location.

40. An emitter as defined in claim 35, wherein the adapter includes means for introducing fluid into at least one of the waveguide and transformer elements.

41. An emitter as defined in claim 1, wherein the waveguide includes spectral structure for controlling local spectral wave by filter means selected from the group consisting of low pass, high pass, band pass, all pass and filters with damping characteristic.

42. An emitter as defined in claim 1, wherein the waveguide is coupled to a plurality of waveguides.

43. An emitter as defined in claim 1, wherein the waveguide is shaped in a curved configuration with the length of the waveguide exceeding the distance between opposing ends of the waveguide.

44. An emitter as defined in claim 1, wherein the waveguide is comprised of flexible material having a complex elasticity module.

45. An emitter as defined in claim 1, wherein the weight guide comprises a structure selected from the group consisting of a moveable diaphragm, a camshaft, a gear wheel drive, a chain drive, a rotary drive mechanism, a rotor-stator device, a wire, a band, a pipe, a bar, a tube, adjacent masses and springs, elements that have mass and spring character, a slit spring, and an expansion chamber.

46. An emitter as defined in claim 1, wherein the waveguide comprises a structure selected from the group consisting of a homogeneous structure, a quasi-homogeneous structure, a segmented structure, and a quasi-segmented structure.

47. An emitter as defined in claim 1, wherein the transformer comprises a structure selected from the group consisting of a homogeneous structure, a quasi-homogeneous structure, a segmented structure, and a quasi-segmented structure.

48. An emitter as defined in claim 1, wherein the waveguide and the transformer elements in combination with the waveguide from a structure selected from the group consisting of a homogeneous structure, a quasi-homogeneous structure, a segmented structure, and a quasi-segmented structure.

49. An emitter as defined in claim 1, wherein the means for impedance termination comprises structure selected from the group consisting of a block absorber, a horn, a friction damper, a viscous damper, a vibrational absorber, and an exciter capable of matching any desired impedance.

50. An emitter as defined in claim 1, wherein the impedance termination means is coupled to a adapter which is coupled between the means for impedance termination and the waveguide.

51. An emitter as defined in claim 35, wherein the impedance termination means is coupled to a second adapter which is coupled between the means for impedance termination and the waveguide.

52. An emitter as defined in claim 1, further including means for adjusting a spectral directivity characteristic of the emitter.

53. An emitter as defined in claim 1, wherein the emitter is positioned at least partially in and is enclosed by a duct.

54. An emitter as defined in claim 53, further comprising structure for displacing the emitter relative to the duct for adjusting acoustic properties of the emitter.

55. An emitter as defined in claim 1, further comprising at least one Helmholtz resonator positioned proximate to the emitter for enhancement of acoustic output.

56. An emitter as defined in claim 1, further comprising at least one additional emitter as defined in claim 1, the emitters being positioned adjacently to enable cooperative operation for enhancement of acoustic output.

57. An emitter as defined in claim 54, wherein the emitters comprise a three-dimensional array.

58. An emitter as defined in claim 54, further comprising a sound source coupled to exciters of the respective emitters for developing stereo output as part of the acoustic output.

59. An emitter as defined in claim 1, further comprising a second exciter disposed as part of a Janus configuration enabling bidirectional propagation of mechanical energy.

60. A method for emitting acoustic energy which is in-phase and directional, said method comprising the steps of:

selecting an elongate waveguide comprised of material and configured with a shape which provides a transfer medium for mechanical waves generated by and received from an exciter member;

propagating mechanical waves into the waveguide;

processing the mechanical waves through a plurality of transformer elements disposed along the waveguide, each transformer element being mechanically coupled to the waveguide and having a structure which is distinguishable from structure of the waveguide because of differences in (i) acoustical shape, (ii) material composition or (iii) acoustical shape and material composition combined, each transformer element having an acoustical shape configured to convert mechanical energy received from the waveguide into acoustical output in a surrounding medium, at least one of the transformer elements being configured in combination with the waveguide for emitting monopole, acoustic radiation; and minimizing reflection of forward traveling waves propagated along the waveguide to avoid cancellation of mechanical energy propagated with the waveguide; and emitting acoustical energy from the waveguide based on conversion of mechanical energy by the transformer elements.

61. An elongate acoustic detector device for detecting acoustic energy in a surrounding environment, and directional, said device comprising:

a detector member capable of converting mechanical wave propagation to a voltage;

an elongate waveguide comprised of material and configured with a shape which provides a transfer medium for acoustical energy received within the waveguide;

an adapter coupled at a first end to the detector member and at a second end to the waveguide, said adapter being comprised of material and configured with a shape which provides efficient transfer of mechanical waves to the detector member and from the waveguide;

a plurality of transformer elements disposed along the waveguide, each transformer element being mechanically coupled to the waveguide and having a structure which is distinguishable from structure of the waveguide because of differences in (i) acoustical shape, (ii) material composition or (iii) acoustical shape and material composition combined, each transformer element having an acoustical shape configured to convert acoustical energy received from the surrounding environment guide into mechanical energy for propagation within the waveguide; and impedance termination coupled to the waveguide for minimizing reflection of propagated energy within the waveguide.

62. A method as defined in claim 60, further comprising the step of arranging elements of the waveguide in an end-fired line in Janus configuration having excitation at both ends for bidirectional propagation.

63. An emitter as defined in claim 1, wherein the transformer elements comprise a series of masses which are respectively separated by spring means.

* * * * *